United States Patent [19]

Johnson

[11] 4,026,395

[45] May 31, 1977

[54] DISPLAY CASE

[76] Inventor: Arthur E. Johnson, 1518 S. Shelton St., Seattle, Wash. 98108

[22] Filed: Aug. 25, 1976

[21] Appl. No.: 717,530

[52] U.S. Cl. ..... 190/16; 206/559; 211/122; 312/134; 198/793; 206/44.11

[51] Int. Cl.[2] ..... A47F 5/02; A45C 3/02

[58] Field of Search ..... 190/16; 206/44.11, 45, 206/72, 77; 211/121, 122; 312/134; 198/793, 797

[56] References Cited

UNITED STATES PATENTS

| | | | |
|---|---|---|---|
| 682,903 | 9/1901 | Bendall | 190/16 |
| 1,938,985 | 12/1933 | Starr | 312/134 |
| 1,963,314 | 6/1934 | Savell et al. | 198/797 |
| 2,266,786 | 12/1941 | Mitchell | 198/793 |
| 2,787,387 | 4/1957 | Scott | 198/797 |

*Primary Examiner*—Stephen P. Garbe
*Assistant Examiner*—Joseph Man-Fu Moy
*Attorney, Agent, or Firm*—Seed, Berry, Vernon & Baynham

[57] ABSTRACT

A display case having a plurality of display trays moving forwardly along a support surface so that articles carried by the trays are visible from above. After the trays have reached the rear of the display case, they are lowered and then moved forwardly below the support surface until they reach the front of the display case where they are lifted onto the support surface and moved rearwardly again. The trays are connected to spaced and parallel continuous chains each extending between a pair of rotatably mounted sprockets adjacent the trays. A crank rotates one of the sprockets through a drive shaft and gear system so that the trays move in accordance with the rotation of the crankshaft.

8 Claims, 4 Drawing Figures

FIG. 1
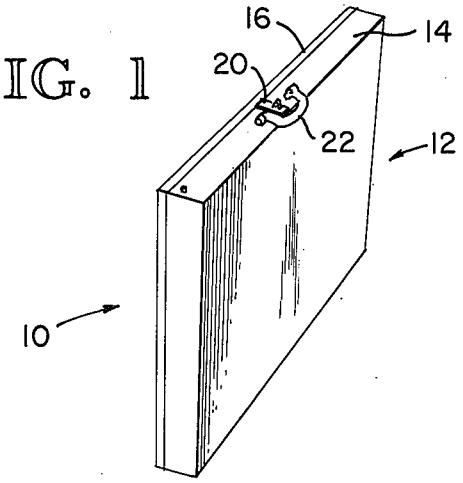
FIG. 2
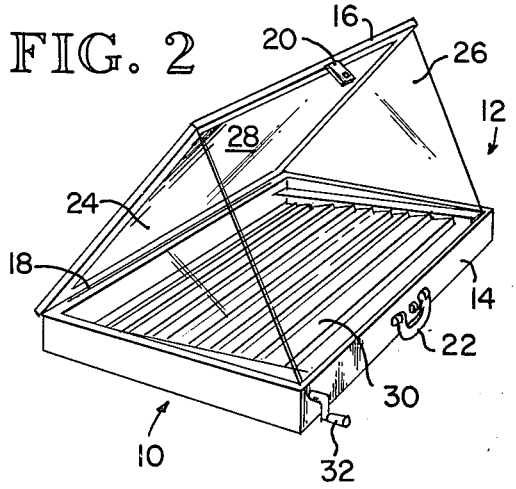
FIG. 3
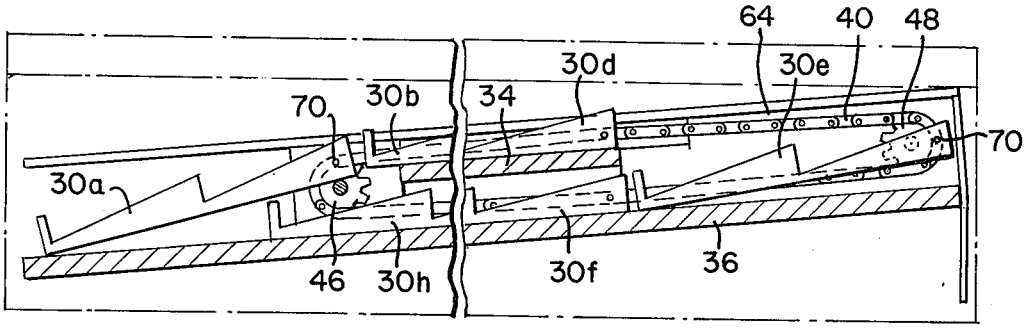
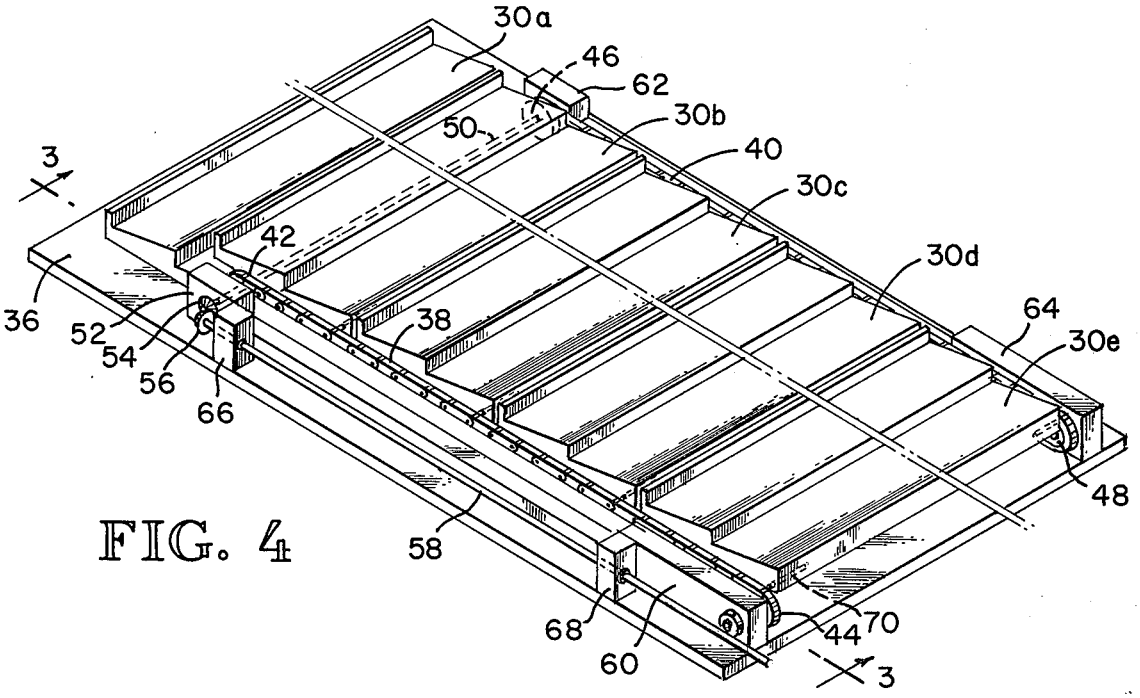
FIG. 4

DISPLAY CASE

BACKGROUND OF THE INVENTION

1. Field of the Invention

This invention relates to display cases, and more particularly, to a display case having a plurality of recirculating trays arranged in a continuous loop.

2. Description of the Prior Art

It is often desirable to display valuable objects, such as coins, jewelry, etc., in a manner in which allows a large quantity of such objects to be displayed within a minimum surface area. One technique for performing this function has been to use a revolving loop of trays in which a plurality of trays circulate in a continuous loop so that each of the trays are sequentially and periodically visible. However, such conventional systems generally require a fairly elaborate support system for the trays thereby making such display cases relatively expensive and heavy. Often the trays recirculate about a vertical plane so that it is not possible to display objects on a flat, horizontal surface. Furthermore, the trays of conventional recirculating display systems are generally somewhat inaccessible thereby making removal of the objects on the tray for examination purposes relatively difficult.

SUMMARY OF THE INVENTION

It is an object of the invention to provide a display case having a plurality of trays which recirculate in a continuous loop utilizing a relatively inexpensive and lightweight tray support system.

It is another object of the invention to provide a display case for simultaneously displaying the contents of a plurality of trays on a flat, horizontal surface.

It is still another object of the invention to provide a display case in which the motion of a plurality of trays can be easily controlled manually by rotating an external crank.

A further object of the invention is to provide a display case having the form of a carrying case thereby making the display case easily transportable.

A still further object of the invention is to provide a display case having a plurality of display trays which are easily accessible during use so that objects can be removed from the tray for examination.

These and other objects of the invention are provided by a plurality of rectangular trays pivotally connected to a closed loop conveyor means extending along both sides of the trays. The trays are moved along an upper support surface by the conveyor means until the rear end of the upper support surface is reached at which point the trays pivot downwardly to contact a lower support surface and the conveyor means carries the trays along the lower support surface in the opposite direction toward the front end of the display case. At the front end of the display case the conveyor means lifts the trays onto the upper support surface where they are once again moved along the surface to display the objects positioned on the trays. The conveyor means may be a loop of chains engaging a pair of sprockets positioned at opposite ends of the case, and one of the sprockets may be rotated through a crank and drive shaft which is connected to the sprocket by a gear system. The upper support surface and the surfaces of the trays may be inclined toward the front of the case thereby improving the viewability of objects positioned on the trays.

BRIEF DESCRIPTION OF THE FIGURES OF THE DRAWING

FIG. 1 is an isometric view showing the display case in its carrying position.

FIG. 2 is an isometric view showing the display case in its display position.

FIG. 3 is a cross sectional view of the display case taken along the line 3—3 of FIG. 4.

FIG. 4 is an isometric view illustrating the internal features of the display case.

DETAILED DESCRIPTION OF THE INVENTION

The display case is illustrated in its closed position for easy portability in FIG. 1. The display case includes a carrying case 12 having a frame portion 14 and a cover 16. The cover 16 is pivotally secured to the frame portion 14 along one edge thereof by a piano hinge 18 (FIG. 2) so that access to the interior of the case 12 is provided by pivotally raising the cover 16. In its carrying position, the cover 16 is maintained in its closed position by a latch 20. A handle 22 is provided for allowing the display case 10 to be more easily transported.

As illustrated in FIG. 2, the display case 12 is placed in its open or display position by supporting the cover 16 in its open position by a pair of generally triangular plexiglass panels 24,26 positioned with adjacent edges contacting the frame 14 and cover 16 and the apex therebetween positioned adjacent the piano hinge 18. The panels 24,26, in addition to supporting the cover 16 in its open position, prevent access to the interior of the case 12 from the front or sides. The major portion of the cover 16 is a transparent panel 28 which allows objects (not shown) positioned on trays 30 to be clearly viewed. The triangular side panels 24,26 and the cover panel 28 may be formed by any suitable transparent sheet such as glass or plexiglass. As explained hereinafter, a crank 32 projecting rearwardly from the frame 14 is rotated to move the trays 30 from front to back.

The internal features of the display case 10 are best illustrated in FIGS. 3 and 4. The case includes a plurality of display trays 30*a–h* each of which have a pair of stepped surfaces inclined toward the front of the case to promote viewability. The trays 30 generally occupy one of two planes with the trays 30 on the upper plane being supported by an upper support surface 34 and the trays 30 occupying the lower plane being supported by a lower support surface 36. As best illustrated in FIG. 3, the support surfaces 34,36 are also inclined toward the front of the case 10 for the purposes of providing better viewability. The trays 30 are connected to a conveyor means which includes continuous chain loops 38,40 extending along opposite sides of the trays 30 between the respective sprockets 42,44,46,48. The link connecting pins or rivets in the chains 38,40 engage teeth on the sprockets 42–48 so that rotation of the sprockets 42–48 circulates the chains 38,40. The front sprockets 42,26 on opposite sides of the trays 30 are connected to each other through a shaft 50 so that rotation of one sprocket 42 causes rotation of the remaining sprockets 44–48. The shaft 50 extends through a support block 52 and terminates in a bevel gear 54 which is engaged by another bevel gear 56 mounted on the end of a drive shaft 58. The drive shaft 58 projects through the rear edge of the display case 12 and terminates in a crank 32 as best illustrated in FIG. 2. The crank 32 and drive shaft 58 are keyed to prevent the shaft 58 from rotating with respect to the crank 32 but the keying allows the crank 32 to be moved axially with respect to the drive shaft 58 so that the crank 32 may be removed from the shaft 58 during transport of the case 10 as illustrated in FIG. 1. The sprockets 42–48 are rotatably mounted on support blocks 52,62,64 which also support the upper support surface 34. A pair of spaced apart support blocks 66,68 rotatably support the drive shaft 58. All of the support blocks 52,60,62,64,66,68 are carried by the lower support surface 36.

The chains 38,40 are pivotally connected to each of the trays 30 by pins 70 which extend inwardly from the chains 38,40 and are received by bores in the side edges of the trays 30 toward the rear edge thereof. The pins 70 carry the trays 30 in a horizontal direction but allow the forward edges of the trays to pivot downwardly as explained hereinafter.

In operation, the trays are moved from front to back by rotating the crank 32 thereby rotating the sprockets 42–48 and causing the chains 38,40 to recirculate. The pins 70 extending from the chains 38,40 and into the trays 30*a–d* positioned on the upper support surface 34 cause the trays to move rearwardly while moving the trays 30*e–h* on the lower support surface 36 forwardly. As best illustrated in FIG. 3, when a tray reaches the rear edge of the upper support surface, the forward edge of the tray 30*e* pivots downwardly to contact the lower support surface 36 and the rear end of the tray 30*e* is lowered downwardly to the lower support surface 36 by the chains 38,40 engaging the sprockets 44,48. The chains 38,40 then carry the trays occupying the lower plane 30*f–h* forwardly beyond the forward edge of the upper support surface 34. The forward edge of the tray 30*a* is then lifted above the lower support surface 36 onto the upper support surface 34 so that the chains 38–40 once again move the trays 30 rearwardly along the upper support surface 34. Objects positioned on any of the trays 30 may be easily displayed by rotating the crank 32 to place the selected tray 30 in proper position.

If desired a small electric motor may be used to rotate the shaft 58 in lieu of the illustrated hand crank.

The embodiments of the invention in which a particular property or privilege is claimed are defined as follows:

1. A display case comprising:

a plurality of rectangular display trays having transverse edges extending between first and second longitudinal edges, said trays being arranged with their longitudinal edges adjacent the longitudinal edges of adjacent trays;

conveyor means positioned adjacent a transverse edge of said display trays, said conveyor means defining an oval loop occupying a vertical plane extending between first and second ends, the upper portion of said loop moving in a first direction toward said first end and the lower portion of said loop moving in a second direction opposite said first direction toward said second end;

connector means joining said conveyor means to each of said trays at a position on said trays toward the first longitudinal edges, said first longitudinal edges being the longitudinal edge of each tray closest to said first end, said connector means advancing said trays along the path of said conveyor means while permitting pivotal movement of said trays about their longitudinal axes;

an upper support surface extending from near said second end toward said first end to a point spaced from said first end approximately one transverse edge of said tray; and a lower, support surface positioned below said upper support surface by at least the thickness of said trays, said lower support surface extending in said first and second directions beyond said upper support tray such that said conveyor means advances said trays along said support surface in said first direction to said first end to where said trays pivot downwardly so that the second edges of said trays contact said lower support surface, said conveyor means then lowering the first longitudinal edges to said lower support surface and then advancing said trays along said lower support surface in said second direction to second end where said first longitudinal edges are lifted onto said upper support surface.

2. The display case of claim 1, wherein said conveyor means comprise:

first and second sprockets rotatably mounted at said first and second ends, respectively;

a continuous loop of chain engaging said sprockets; and drive means for selectively rotating one of said sprockets.

3. The display case of claim 2, wherein said drive means comprise:

a first beveled gear mounted on one of said sprockets and adapted to rotate therewith;

a rotatably mounted drive shaft extending from a point external of said case to a point adjacent said first beveled gear;

a second beveled gear mounted on the end of said drive shaft adjacent said bevel gear, said second bevel gear meshing with said first bevel gear; and a crank mounted at the other end of said drive shaft such that rotation of said crank rotates said sprockets through said drive shaft and bevel gears thereby moving said display trays along said first and second support surfaces.

4. The display case of claim 1, wherein said support surface is inclined toward one of said ends such that objects on said trays face toward an individual standing at said ends thereby improving the visibility of objects positioned on said trays.

5. The display case of claim 1, wherein the surfaces of said trays are inclined toward one of said ends such that objects on said trays face toward an individual standing at said end thereby improving the viewability of objects positioned on said trays.

6. The display case of claim 1, wherein said trays, conveyor means, connector means, and support surfaces are housed in a carrying case having a rectangular frame in a cover pivotally secured to said frame along one edge thereof, said cover having a transparent cover panel through which objects on said trays may be viewed.

7. The display case of claim 6, further including a generally triangular side panel positioned at each side of said carrying case with two adjacent edges of said panels contacting said cover and frame, respectively, and the apex between said edges positioned adjacent the junction between said cover and frame such that said side panels maintain said cover in an open position to allow access to objects carried by said trays while restricting side access to said objects.

8. The display case of claim 3, wherein said crank is keyed to said drive shaft so that said crank rotates with said drive shaft while bring removable from said drive shaft such that said projecting crank may be removed from said display case while said display case is being transported.

* * * * *